United States Patent [19]

Bollon et al.

[11] 4,384,235

[45] May 17, 1983

[54] LINEAR FILAMENT ASSEMBLY WITH REFRACTORY INSULATING SUPPORT ROD FOR HALOGEN LAMP

[75] Inventors: Anthony W. Bollon, London; Christopher J. Clark, Wembley, both of England

[73] Assignee: Thorn EMI Limited, London, England

[21] Appl. No.: 151,646

[22] Filed: May 20, 1980

[30] Foreign Application Priority Data

May 22, 1979 [GB] United Kingdom ..... 7917819

[51] Int. Cl.[3] ..... H01K 1/18; H01K 1/50

[52] U.S. Cl. ..... 313/276; 313/279; 313/579

[58] Field of Search ..... 313/279, 222, 276, 275

[56] References Cited

U.S. PATENT DOCUMENTS 2,901,658 8/1959 Pero et al. ..... 313/279
3,891,885 6/1975 Wurster ..... 313/222 X

FOREIGN PATENT DOCUMENTS 1122143 5/1956 France ..... 313/279
1035454 7/1966 United Kingdom .
1451877 10/1976 United Kingdom .
1505749 3/1978 United Kingdom .

*Primary Examiner*—Palmer C. Demeo
*Attorney, Agent, or Firm*—Fleit & Jacobson

[57] ABSTRACT

A linear filament assembly for a halogen cycle incandescent lamp comprises a generally linear filament (usually a coil or coiled coil) supported at opposite ends by substantially rigid conductive leads, a rigid insulating rod, for example of quartz, extending generally parallel to the filament, and a plurality of supports extending between the rod and the filament, each support being fixedly secured to the rod, for example by having a coil part fitting over the rod and also being formed with a coil loosely exbracing the filament. The coils embracing the filament preferably include several closely spaced turns which loosely embrace part of the filament coil, without screwing into or engaging individual pitches of the latter.

11 Claims, 2 Drawing Figures

LINEAR FILAMENT ASSEMBLY WITH REFRACTORY INSULATING SUPPORT ROD FOR HALOGEN LAMP

Figure 1:
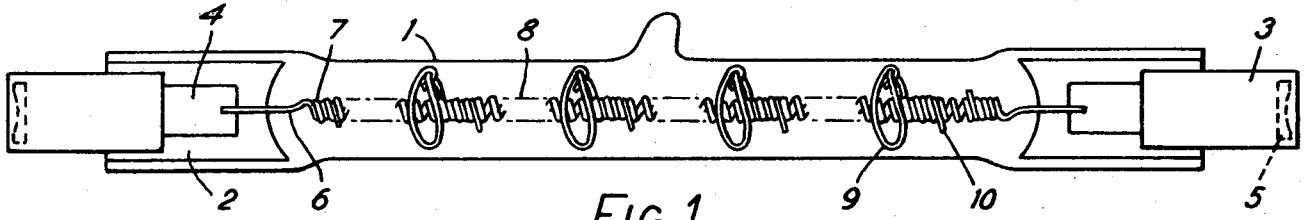
FIG. 1 PRIOR ART

The present invention relates to so-called linear filament lamps, and more particularly to filament supports for linear filament halogen regeneration cycle lamps and to filament assemblies for such lamps.

In the design of low power tungsten halogen lamps a problem arises from the need to support the fragile fine filaments, required for low power operation, along their length. Conventional intermediate supports for linear tungsten-halogen lamp filaments take the form of spirals of refractory metal wire, usually tungsten, fitting loosely in the lamp tube and terminating in an axially located coil which is secured into or otherwise meshes with the filament coil over two or three turns.

Essentially, the filament serves to retain the support in position, but this has several disadvantages. First, the filament must be strong enough to avoid distortion and damage when the support is wound or secured on to it, which damage can lead to premature lamp failure. The filament must also be capable of holding the support. These requirements limit the structure to lamps of relatively high power and correspondingly coarse filaments. Second, on failure of the filament, the supports tend to collapse, causing the broken filament ends to draw apart and form an arc: this arc could explosively destroy the lamp, and a fuse is required to suppress it. There is also a risk that the hot filament ends may touch the tube wall and puncture it. A third, and important objection, is that there is considerable cooling of the filament over the region of contact with the support: this leads to an uneven temperature along the filament and to a shorter lamp life, owing to transport of the refractory metal from one point of the filament to another in accordance with the temperature gradients.

Furthermore, if the lamp is run at an angle, and especially vertically, the weight of the supports can stretch the filament and cause short life. This is particularly the case with lower wattages where the support is relatively heavy in relation to the filament.

An alternative form of filament support has been described in British Pat. No. 1505749. This support comprises two coil portions, the first of free external diameter greater than the internal diameter of the tube into which it is to be fitted and the second of diameter less than the first coil portion and larger than the diameter of the filament. On insertion the larger coil portion is compressed and expands against the tube to be retained in position while the filament is inserted into and supported by the smaller portion.

While this support arrangement does provide firm support for the filament it also relies on a friction fit against the tube wall and thus needs a rigid support made from relatively thick wire which tends to conduct heat away from the filament. At least for this reason we believe that it still leads to localised cooling of the filament with the consequent problems described hereinbefore.

It has also been proposed to support a linear filament in a tubular lamp envelope by means of a glass rod extending along-side the filament and supported at its ends by the filament leadwires. The filament itself is then supported at intervals along its length by wires anchored at one end in the rod and terminating at the other end on a broken loop or "pigtail" embracing the filament. An example of such a structure is shown in British Pat. No. 1035454. A similar support arrangement using a support tube of quartz glass or fused silica is shown in U.S. Pat. No. 3,891,885.

This support is considered to be unsatisfactory for low power tungsten halogen lamps at least because merely looping the support wire around the filament does not give sufficient support.

It is an object of this invention to provide a filament support assembly for which the problems mentioned hereinbefore are reduced. It is another object to provide a filament assembly in which the filament can be assembled and tensioned as desired before insertion into the lamp tube.

According to the invention there is provided a linear filament assembly for a halogen cycle incandescent lamp, the assembly including a generally linear coiled filament supported at opposite ends by substantially rigid conductive leads, a rigid refractory insulating rod extending generally parallel to the filament and a plurality of supports extending between the rod and the filament, each support being securely fixed to the rod and being formed with a support coil of two or more turns of the same diameter, the pitch and diameter of the turns being chosen such that the support coil loosely embraces and supports the filament coil without meshing therein.

The loose supports also enable the filament to be tensioned as desired during completion of the support and filament assembly. The support coils should have sufficient turns to ensure that the filament does not fall through the supports, and to locate the filament more securely in the centre of the tube or bulb. This is important because low power linear halogen lamps require bulbs of small diameter in order to achieve the wall temperature necessary to the halogen cycle. The coils at the rod end of the supports may be a push fit on the rod but in any case should be firmly secured to the rod to prevent axial movement there along, especially in the event of the filament breaking.

The rod may be made from quartz, high silica content glass (for example that known by the Trade Mark VYCOR), high melting point aluminosilicate or borosilicate glass, or possibly an insulating ceramic. In a tungsten halogen lamp it is preferably of quartz or Vycor.

It is also preferred that the filament and the rod should be separately connected to a respective conducting end member at each end of the assembly. In this way the assembly may be formed as a rigid pre-tensioned unit ready for fitting into a lamp tube, the end member being embedded in the seal regions at the ends of the tube in the finished lamp.

The end members are conveniently of refractory metal foil; and the ends of the rod may be supported by rigid end supports formed with terminal coils fitting the ends of the rod. If the end supports and the leads are both of refractory metal, they can then be directly welded to the foil member. Among other alternatives, the rod may be itself directly sealed in the pinch seal or seals of the lamp.

It is further preferred that the leads should be helically grooved or threaded, and screwed into the filament coil, rather than welded or clamped to it. This gives a stronger and more reliable connection and ensures that the lead is coaxial with the filament coil. Other kinds of filament lead or tail can, however, be used.

The supports according to the invention enable filaments of any desired thickness to be used, for example for lamps of 100 to 1500 W power. They reduce the severity for the arc on failure of the filament and may enable the expensive fuse, hitherto necessary, to be omitted. They also prevent the hot broken ends of a failed filament from touching the tube wall.

The supports according to the invention have also been found to increase the life of tungsten filaments in halogen lamps, apparently due to local reduction in tungsten transport, which can be ascribed to the more even temperature along the filament and consequent reduction in local erosion.

Since the filament is held independently without the additional weights of the supports dragging it down the lamp may be run at an angle or even vertically.

The invention is particularly suitable for low power tungsten halogen lamps.

Figure 2:
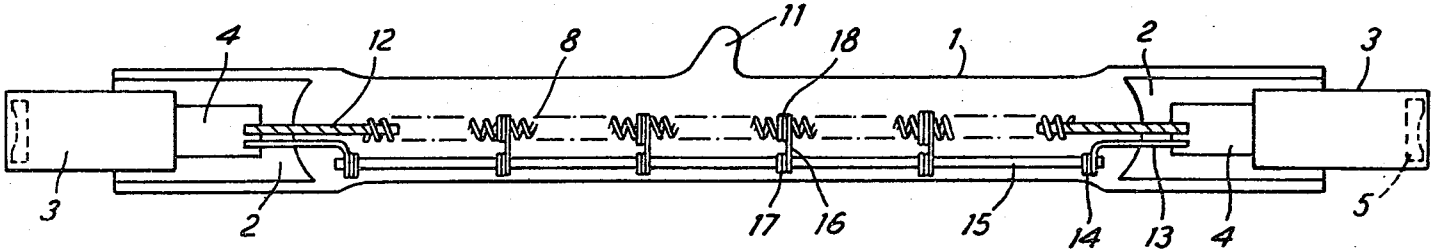

In the accompanying drawings, like reference numerals indicate like parts and:

FIG. 1 shows a side elevation of a linear halogen lamp having spiral filament supports of known type; and FIG. 2 is a similar view of one example of a lamp having supports according to this invention.

In the known lamp of FIG. 1, the tubular envelope of 1 of quartz is sealed at either end with pinch seals 2 fitted with ceramic caps 3. Molybdenum foil strips 4 in the seals connect contacts 5 with filament leadwires 6, which terminate in screw coils 7, screwed into the ends of the coil (or coiled coil) filament 8. The spaced filament supports 9 are spirals of tungsten wire fitting loosely in the tube 1 and terminating axially in coils 10 which are wound into the filament coil and mesh over several turns.

In the preferred embodiment of the invention, shown in FIG. 2 the lamp comprises as in FIG. 1 a tubular quartz envelope 1 sealed at both ends by the pinch seals 2 and provided with ceramic end caps 3 and an exhaust tubulation 11. In the finished lamp the envelope contains a fill of inert gas and halogen vapour in accordance with well known requirements for a halogen regeneration cycle.

The coiled filament 8, preferably of tungsten wire, extends generally linearly along the tube in an approximately axial position and is supported at its ends by threaded or helically grooved leads 12, also preferably of tungsten, which are screwed into the coil of the filament. The leads 12 are welded to respective foil end members 4, preferably of molybdenum, which in the finished lamp are embedded in the seals 2. The foils 4 are in turn connected to end contacts 5.

Also welded to the foil members 4 are end supports 13, preferably of tungsten wire which terminate in coils 14 fitting on and supporting the ends of a rigid insulating refractory rod 15 extending parallel to the filament coil 8. The rod 15 affords support to the filament by means of individual supports 16, also preferably formed of tungsten wire, although tantalum wire or molybdenum wire can also be employed. The support 16 each have, in this example, at one end a coil 17 which is a push fit on the rod 15, and at the other end a close coil 18 of several turns which loosely embraces the filament coil. In this way the filament is supported in a manner which minimizes damage in transit or operation.

The filament 8, leads 12, and foils 4, end supports 13, quartz rod 15 and supports 16 together form an assembly that can be fabricated in a suitable jig to provide a rigid unit, which can conveniently be introduced into a lamp tube during manufacture of the lamp, the filament being held at the desired pre-set tension during sealing of the tube and thereafter.

In practical experiments we have found that, whereas 200 W lamps at a loading of 14 Lumens/Watt would be expected to have a life of 2000 hours, lamps of this rating embodying the invention, which we have tested, have had lives exceeding 5000 hours.

The following Table shows average filament temperature values, established by micro-pyrometric color temperature measurement, at points along the filament corresponding to the support region and at regions mid-way between the support, in two types of lamp of 300 W rating, the conventional lamp having support spirals with coils enmeshed with about three turns each of the filament coil and thus conducting the heat from the filament and the lamp according to the invention having support wire coils loosely engaging the filament coil and therefore conducting less of the heat from the filament.

TABLE

| | Free filament | Support region |
|---|---|---|
| Conventional | 2700 ± 30° C. | 2020 ± 50° C. |
| Invention | 2590 ± 15° C. | 2200 ± 60° C. |

What we claim is:

1. A linear filament assembly for a halogen cycle incandescent lamp, the assembly including: a generally linear coiled filament; respective conductive filament supports secured to the ends of the filament; respective metal foil elements secured to the filament supports; a refractory insulating rod extending alongside the filament coil; respective end supports connecting the ends of the rod to the metal foil elements; a plurality of wire supports spaced at intervals along the filament, each support wire being securely fixed to the rod and being formed with a coil of at least two turns of substantially the same diameter, the turns being sufficiently close to support the filament coil, wherein the pitch and diameter of the coil part are such that it loosely embraces and supports the filament coil without meshing therewith.

2. An assembly according to claim 1 wherein the pitch of the turns of the support coil is smaller than that of the filament coil.

3. An assembly according to claim 1 in which the conductive filament supports are helically grooved or threaded and are screwed into the filament coil.

4. An assembly according to claim 1 in which each support is formed with a further coil part fitting over the rod to securely fix the support thereto.

5. An assembly according to claim 4 in which the further coil part of each support is a push fit on the rod.

6. An assembly according to claim 1 in which each end of the rod is supported by respective rigid end supports, each end support being formed with a terminal coil fitting the end of the rod to connect the rod to the metal foil element.

7. An assembly according to claim 1 in which the filament, is of tungsten, the wire supports are of refractory metal and the rod is of quartz.

8. An assembly according to claim 7 in which the wire supports are of tungsten.

9. An assembly according to claim 7 in which the wire supports are of tantalum.

10. An assembly according to claim 7 in which the wire supports are of molybdenum.

11. An assembly according to claim 1 including a tungsten filament.

* * * * *